United States Patent [19]

Linden et al.

[11] 4,209,136

[45] Jun. 24, 1980

[54] TABLET CRUSHER

[76] Inventors: Folke D. Lindén, Gamla Norräljevägen 50, S-18010 Enebyberg, Sverige; Jan A. Norberg, Högsätravägan 2, S-18158 Lidingo, Sverige, both of Sweden

[21] Appl. No.: 946,012

[22] Filed: Sep. 26, 1978

[51] Int. Cl.[2] ..... B02C 19/08

[52] U.S. Cl. ..... 241/169.2; 241/199.11; 241/DIG. 27

[58] Field of Search ..... 241/168–169.2, 241/199, 199.3, 199.4, 199.9, 199.11, 270, 274, DIG. 27

[56] References Cited

U.S. PATENT DOCUMENTS

| | | | |
|---|---|---|---|
| 2,209,386 | 7/1940 | Chott | 241/DIG. 27 |
| 2,546,739 | 3/1951 | Georgeina et al. | 241/199.11 |
| 3,915,393 | 10/1975 | Elkins | 241/DIG. 27 X |
| 4,003,523 | 1/1977 | Doolittle | 241/169.2 |
| 4,121,775 | 10/1978 | Roseberg et al. | 241/169.2 X |

FOREIGN PATENT DOCUMENTS

| | | | |
|---|---|---|---|
| 2807174 | 8/1978 | Fed. Rep. of Germany | 241/DIG. 27 |

*Primary Examiner*—Howard N. Goldberg
*Attorney, Agent, or Firm*—Lewis H. Eslinger

[57] ABSTRACT

A device for the crushing of medicinal tablets, comprising a base with a cavity for holding and enveloping at least the lower part of a beaker for containing one or more tablets which are to be crushed, a shaft with a handle at one end thereof and a crushing head at the other, a cap movable along said shaft and provided with a ramming surface at its surface facing the crushing head, said ramming surface cooperating with a similar ramming surface on said crushing head in order to effect, by a knocking action, the removal of any crushed tablet or powder present on the crushing head, said knocking action being effected by retaining both the cap and the handle, and then allowing the cap to fall against said crushing head.

6 Claims, 8 Drawing Figures

FIG 5
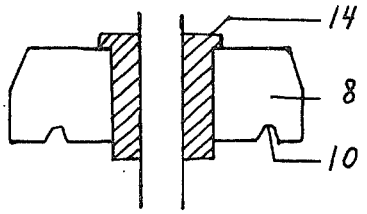
FIG. 7
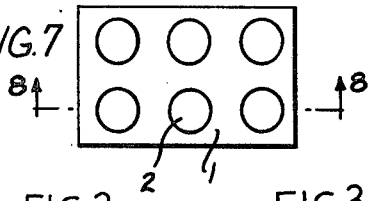
FIG 2
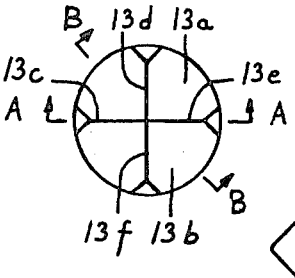
FIG 3
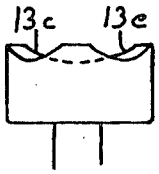
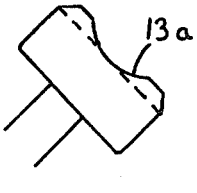
FIG 4
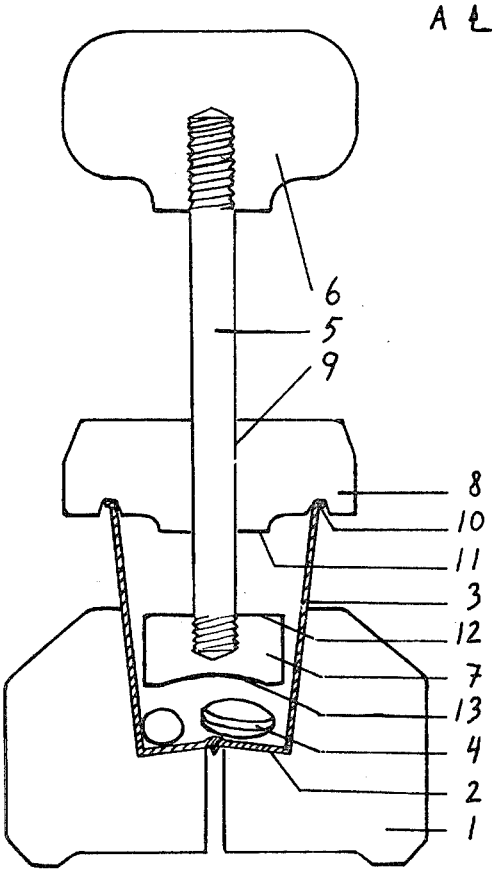
FIG 1
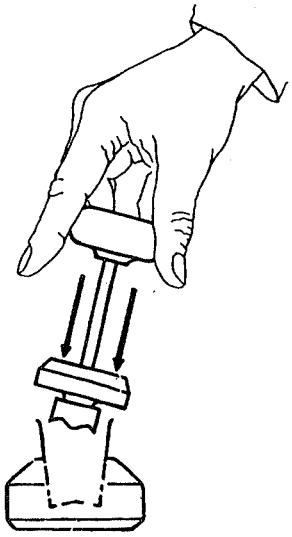
FIG 6
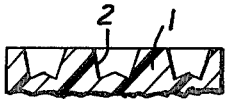
FIG. 8

TABLET CRUSHER

The present invention relates to a device for the crushing of medicinal tablets.

Dispensing medicine in the form of tablets has many hygienic advantages. In particular, the dispensed dosage is exact. At health institutions such as hospitals, the dispensing of medicines to patients is controlled by strict routines. Normally a whole tray is prepared with the daily dose of medicines for all patients in a particular ward. One difficulty with this procedure is that some patients cannot swallow tablets whole but have to have them crushed first. In such cases the nurse responsible for dispensing the medicine has to crush the tablets, either by improvising with a spoon, or by using a mortar. In both cases it is difficult to clean the implement used properly, and there is an attendant risk of contamination when the next patient's medicine has to be crushed using the same tool. Such contamination can of course lead to medical problems for the next patient. Also the actual crushing process involves a further disadvantage since particles of powder can get spread around the room, said particles eventually possibly causing allergic reactions to the staff dispensing the medicine. Finally, crushed tablets often form a cake of powder hindering oral application—this is a common problem when tablets are hygroscopic and are allowed to stay in the open air for several hours before being given to the patients.

Appliances for the crushing of medicinal tablets are known from U.S. Pat. Nos. 3,915,393 and 4,003,523. The appliances disclosed in these specifications suffer the disadvantage that the tablets, after being crushed in a beaker or mortar, forms a cake of powder which, in its turn, has to be broken up. The first appliance described in U.S. Pat. No. 3,915,393 also requires an extra dispensable beaker which is thrown away after crushing. This, of course, increases the costs involved. Moreover, there is still a risk of exposure to dust particles in the room where the extra beaker is disposed of.

In the appliances described in U.S. Pat. No. 4,003,523, the whole crushing tool has to be cleaned after each use thereof which complicates the process, especially in hospital wards.

According to this invention there is provided a device for the crushing of medicinal tablets, comprising a base with a cavity for holding and enveloping at least the lower part of a beaker for containing one or more tablets which are to be crushed, a shaft with a handle at one end thereof and a crushing head at the other, a cap movable along said shaft and provided with a ramming surface at its surface facing the crushing head, said ramming surface cooperating with a similar ramming surface on said crushing head in order to effect, by a knocking action, the removal of any crushed tablet or powder present on the crushing head, said knocking action being effected by retaining both the cap and the handle, and then allowing the cap to fall against said crushing head.

In order that the invention may be more readily understood and so that further features thereof may be appreciated the invention will now be described by way of example with reference to the accompanying drawings, in which:

FIG. 1 is a cross-sectional view of a device in accordance with the invention,

FIG. 2 is a plan view of the crushing area of the crushing head of the device shown in FIG. 1, FIGS. 3 and 4 are plan views of the crushing head illustrated in FIG. 2 as seen from lines A—A and B—B respectively in FIG. 2, FIG. 5 is a cross-sectional view of an alternative embodiment of the cap;

FIG. 6 is a side view illustrating how the weight of the cap is used to knock the crushing head when the cap falls, thus removing tablet remainders from the tool.

FIG. 7 is a plan view of the base of FIG. 1; and

FIG. 8 is a cross-sectional view of the base of FIG. 7, taken along lines 8—8 thereof.

Referring to the drawings a tablet crusher comprises a base 1 which is placed on a support such as a trolley bench or table. A cavity 2 in the base is so shaped that it envelopes and holds at least the bottom part of a beaker 3, suitably of a dispensible type. The beaker 3 has a conical base. One or more medical tablets 4 to be crushed are placed in the beaker.

The crushing tool comprises a shaft 5 with a handle 6 fixed to one end thereof and a crushing head 7 resembling a jagged pestle affixed to the other. A cap 8 is movable along the shaft 5 the shaft 5 extending through a bore 9 which is located centrally in the cap, the lower surface of the cap facing the crushing head has a circular groove 10 dimensioned to accommodate a lip of the beaker 3, thus enabling the crushing tool to be placed centrally over the beaker 3. The cap also has a ramming surface 11 which can engage a similar surface 12 on the crushing head 7. The crushing head's crushing surface is illustrated in detail in FIGS. 2–4.

The crushing head comprises a cylinder in one end 13 of which two cylindrical grooves 13*a* and 13*b*, at right angles to each other, are milled, thereby creating four perpendicular ridges 13*c*, *d*, *e* and *f*. Thus, the two elliptic ridges 13*c* and *e* are connected to each other to form a ridge the contour of which is generally adapted to the angle of taper of the bottom of the beaker. In similar fashion ridges 13*d* and *f* form a ridge the contour of which is generally adapted to said angle of taper. After milling, the crushing surface is polished. Of course it is not critical that the crushing surface has this particular form—other designs may as well be developed.

The important feature, however, is that the crushing surface does not have any recesses or irregularities into which tablet powder can get pressed and stuck. In a tested embodiment of the invention the crushing head and the shaft have been made of solid stainless steel and the cap, base and handle have been made of heavy-duty polyacetal resin.

An important factor affecting the functioning of the device is the height of the cylindrical crushing head—this must be such that in use, none of the crushed powder collects on the upper surface (ramming surface 12) of the crushing head.

As will be evident from subsequent description, it is important that the cap 8 has a suitable weight. If the cap is made of a material with low density, then its weight can be increased by embedding in it a bushing 14 of high density metal (as indicated in FIG. 5) or by affixing high density material to the cap in a suitable manner.

The device is used in the following way. The beaker with the tablets is placed in the cavity 2. The cap is placed centrally over the beaker with groove 10 lying over the top edge of the beaker. The tablets are then crushed by pressing the tool down and turning the handle whilst applying pressure. The handle, which preferably has the form of a circular disc, can then be spun a few revolutions, thus breaking up any cakes of powder which might have been formed when crushing, and releasing most of the powdered material from the crushing surface. Then, holding the handle and the cap (at the top of the shaft) with one's fingers, the crushing tool is lifted a short distance above the base. After this, the cap—but not the handle—is released. The cap falls down, ramming against the crushing head and knocking off any crushed tablet or powder that might be on the crushing surface. Thereafter the beaker is removed from the base (and can be placed, for example on the tray mentioned in the introduction) and the device is ready to be used again, possibly after a final dusting of the crushing surface with a clean piece of soft paper.

In another embodiment of the invention, the base 1 can be in the form of a tray with a number of cavities 2 arranged in rows, each cavity being intended for a different beaker, for example, as shown in FIGS. 7 and 8.

What we claim is:

1. A device for crushing medicinal tablets, comprising a base having a cavity formed therein for holding and enveloping at least the lower part of a beaker adapted to contain at least one tablet to be crushed, a shaft, a handle mounted at one end of the shaft and a crushing head mounted at the other end of the shaft, a cap surrounding and movable along said shaft, said cap having a ramming surface formed facing the crushing head, said ramming surface cooperating with a similar ramming surface on said crushing head to effect, by a knocking action, the removal of crushed tablet and powder present on the crushing head, said knocking action being effected by holding both the cap and handle in a relatively fixed position, and then allowing the cap to fall against said crushing head.

2. A device as claimed in claim 1, wherein said cap has a lower side which has a circular grooved formed therein, dimsioned to accommodate the upper edge of the beaker, said groove serving to center the element consisting of said crushing head, shaft and handle, vertically over the beaker.

3. A device as claimed in claim 1 including means for increasing the weight of the cap.

4. A device as claimed in claim 3 wherein said means comprises a metal bush in the cap surrounding said shaft.

5. A device as claimed in claim 1 wherein the crushing head has the form of a round cylindrical member including a flat upper surface forming said ramming surface, and a jagged lower surface forming a crushing surface, said lower crushing surface having means to crush the tablets, and means to break up, when the head is spun, any cakes of powder which might be formed.

6. A device as claimed in claim 1 wherein said base has several cavities formed therein, each cavity being adapted to receive one beaker.

* * * * *